US008029426B2

(12) United States Patent
Sohn

(10) Patent No.: US 8,029,426 B2
(45) Date of Patent: Oct. 4, 2011

(54) MAT FOR EXERCISE

(76) Inventor: Dae-up Sohn, Seoul (KR)

( * ) Notice: Subject to any disclaimer, the term of this patent is extended or adjusted under 35 U.S.C. 154(b) by 123 days.

(21) Appl. No.: 12/517,843

(22) PCT Filed: Dec. 5, 2007

(86) PCT No.: PCT/KR2007/006261

§ 371 (c)(1),
(2), (4) Date: Jun. 5, 2009

(87) PCT Pub. No.: WO2008/069558

PCT Pub. Date: Jun. 12, 2008

(65) Prior Publication Data

US 2010/0323862 A1 Dec. 23, 2010

(30) Foreign Application Priority Data

Dec. 7, 2006 (KR) ..... 10-2006-0123739

(51) Int. Cl.
*A63B 26/00* (2006.01)

(52) U.S. Cl. ..... 482/145; 482/140

(58) Field of Classification Search ..... 482/23, 482/35, 91, 104, 131, 140, 142, 148, 907, 482/145; D21/676, 792, 797, 798, 686, 690; D6/583, 596; 5/420, 690; 273/285, 286
See application file for complete search history.

(56) References Cited

U.S. PATENT DOCUMENTS 3,242,509 A * 3/1966 Nissen ..... 5/420
3,284,819 A * 11/1966 Nissen ..... 5/420
3,319,273 A * 5/1967 Solin ..... 5/420
4,037,591 A * 7/1977 Sarno ..... 601/57
D255,523 S * 6/1980 Yarabinec ..... D6/596
4,205,669 A * 6/1980 Hamann ..... 5/603
4,489,936 A * 12/1984 Dal Monte ..... 482/96
4,509,748 A * 4/1985 Bezak ..... 482/140
4,815,732 A * 3/1989 Mahvi ..... 482/142
4,905,990 A * 3/1990 DeSantis ..... 482/23
(Continued)

FOREIGN PATENT DOCUMENTS

JP 56-042266 U 4/1981
(Continued)

OTHER PUBLICATIONS

International Search Report of International Application No. PCT/KR2007/006261.

*Primary Examiner* — Loan Thanh
*Assistant Examiner* — Tam Nguyen
(74) *Attorney, Agent, or Firm* — Kile Park Goekjian Reed & McManus PLLC

(57) ABSTRACT

Disclosed is a mat for exercise. The mat comprises a main mat having a foot hanger for a sit-up at a top surface of one side thereof and a plurality of grooves at a bottom surface of both lateral sides thereof, a plurality of sub-mats coupled with the main mat in use, and a plurality of attachment plates installed at corners of a bottom surface of the main mat and corners of bottom surfaces of the sub-mats, wherein the main mat is provided with female fabric hook-and-loop fastener (e.g., Velcro) tapes mounted at the grooves thereof, and the sub-mat is provided with male fabric hook-and-loop fastener (e.g., Velcro) tapes that laterally protrude corresponding to the grooves of the main mat.

10 Claims, 6 Drawing Sheets

U.S. PATENT DOCUMENTS

| | | | | |
|---|---|---|---|---|
| 5,122,106 | A * | 6/1992 | Atwood et al. | 482/131 |
| 6,062,930 | A * | 5/2000 | Smith | 441/129 |
| 6,322,485 | B1 * | 11/2001 | Marrero | 482/140 |
| 6,691,356 | B1 * | 2/2004 | Coma | 5/722 |
| 7,207,932 | B1 * | 4/2007 | Dean | 482/140 |

FOREIGN PATENT DOCUMENTS

| | | | |
|---|---|---|---|
| JP | 2000-135298 | A | 5/2000 |
| JP | 2002-045437 | A | 2/2002 |
| KR | 10-2002-0026218 | A | 4/2002 |

* cited by examiner

[Fig. 1]
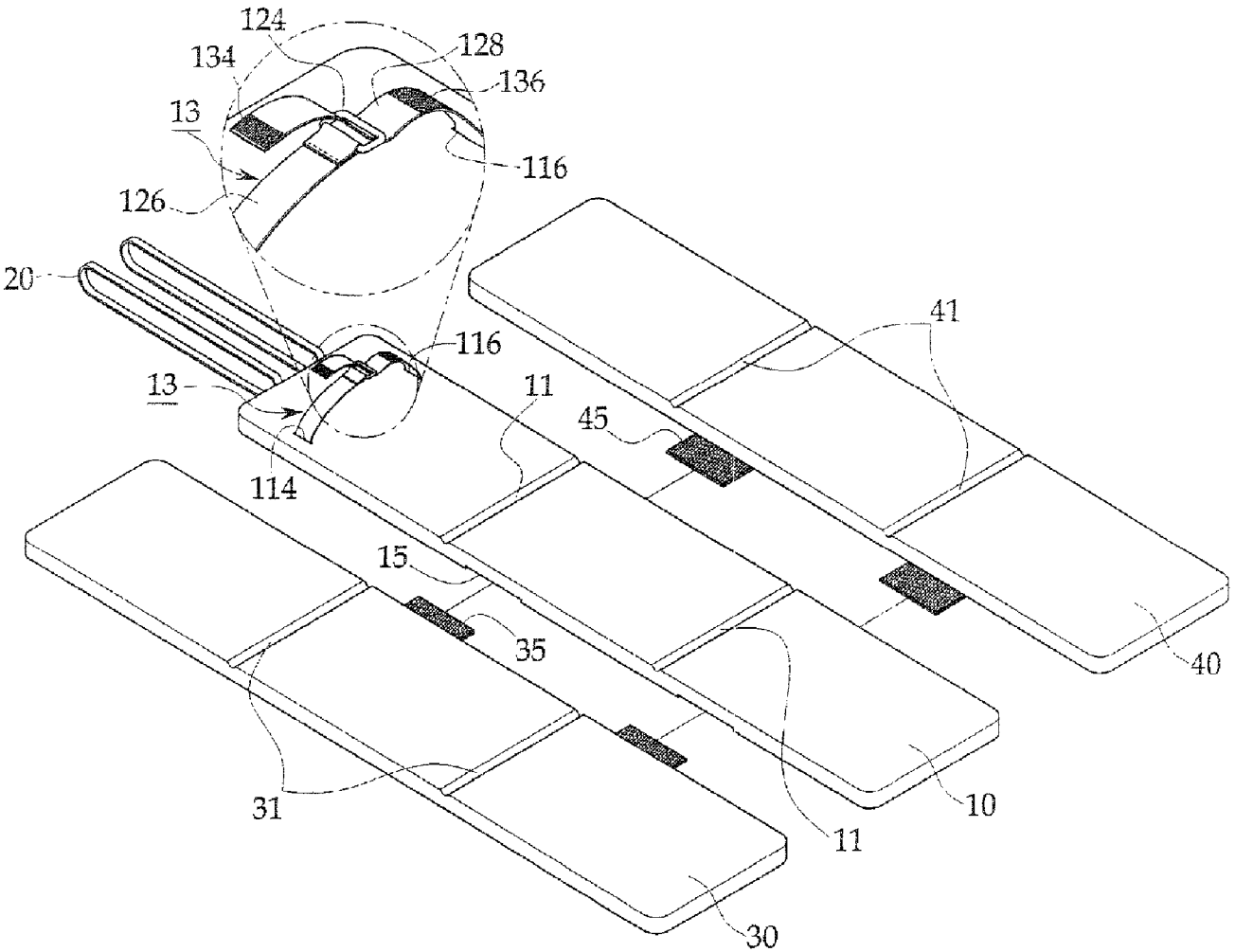

[Fig. 2]
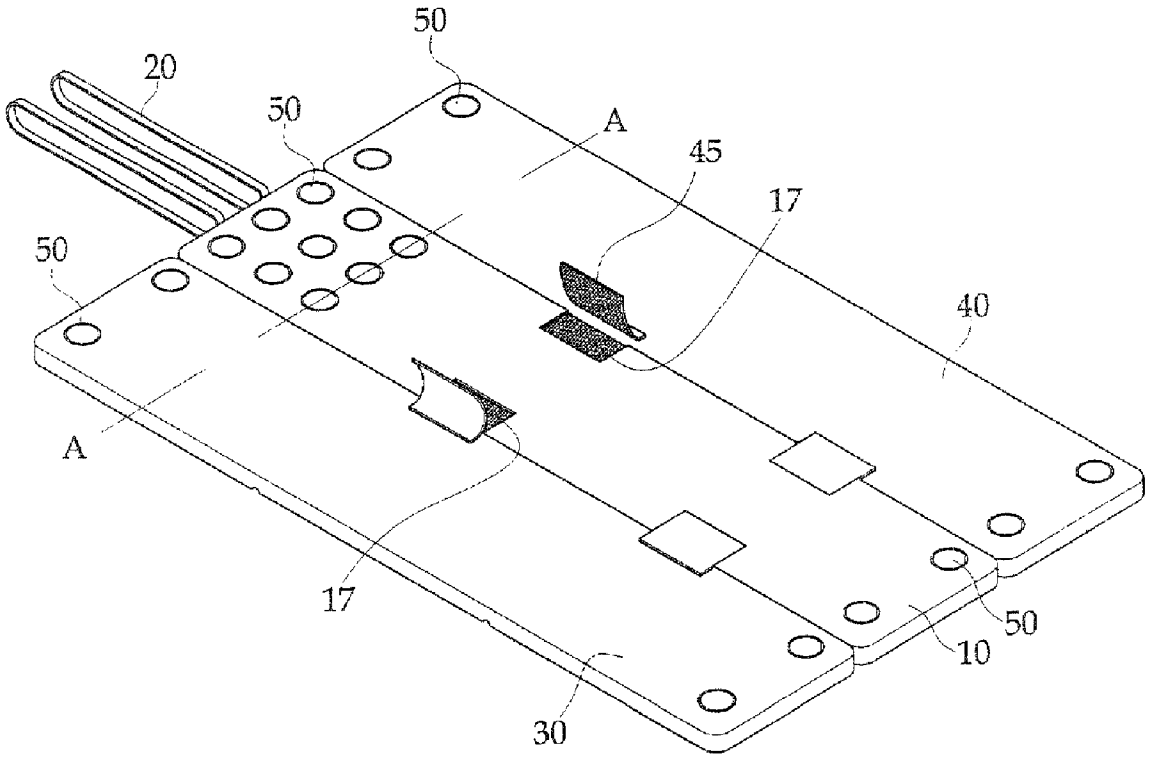
[Fig. 3]
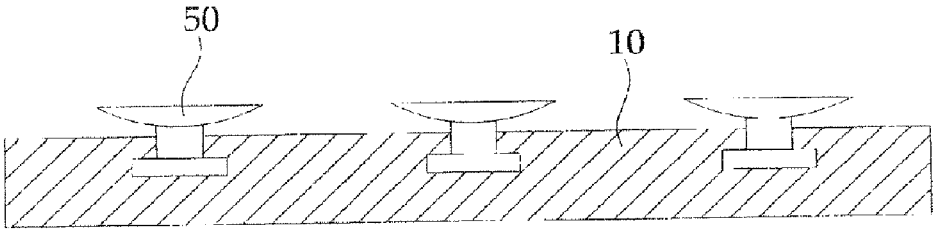
A-A

[Fig. 4]
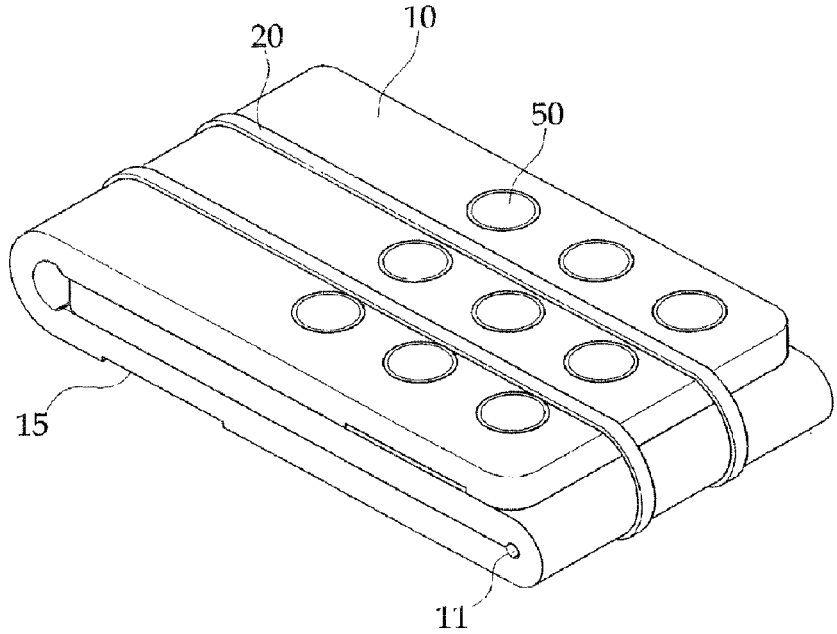
[Fig. 5]
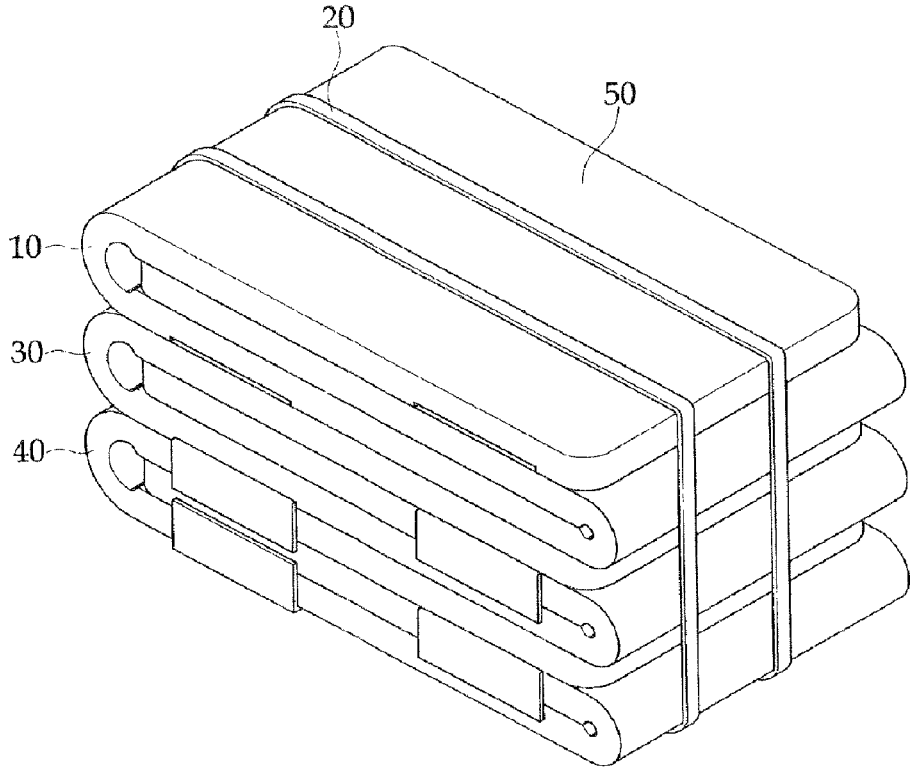

[Fig. 6]
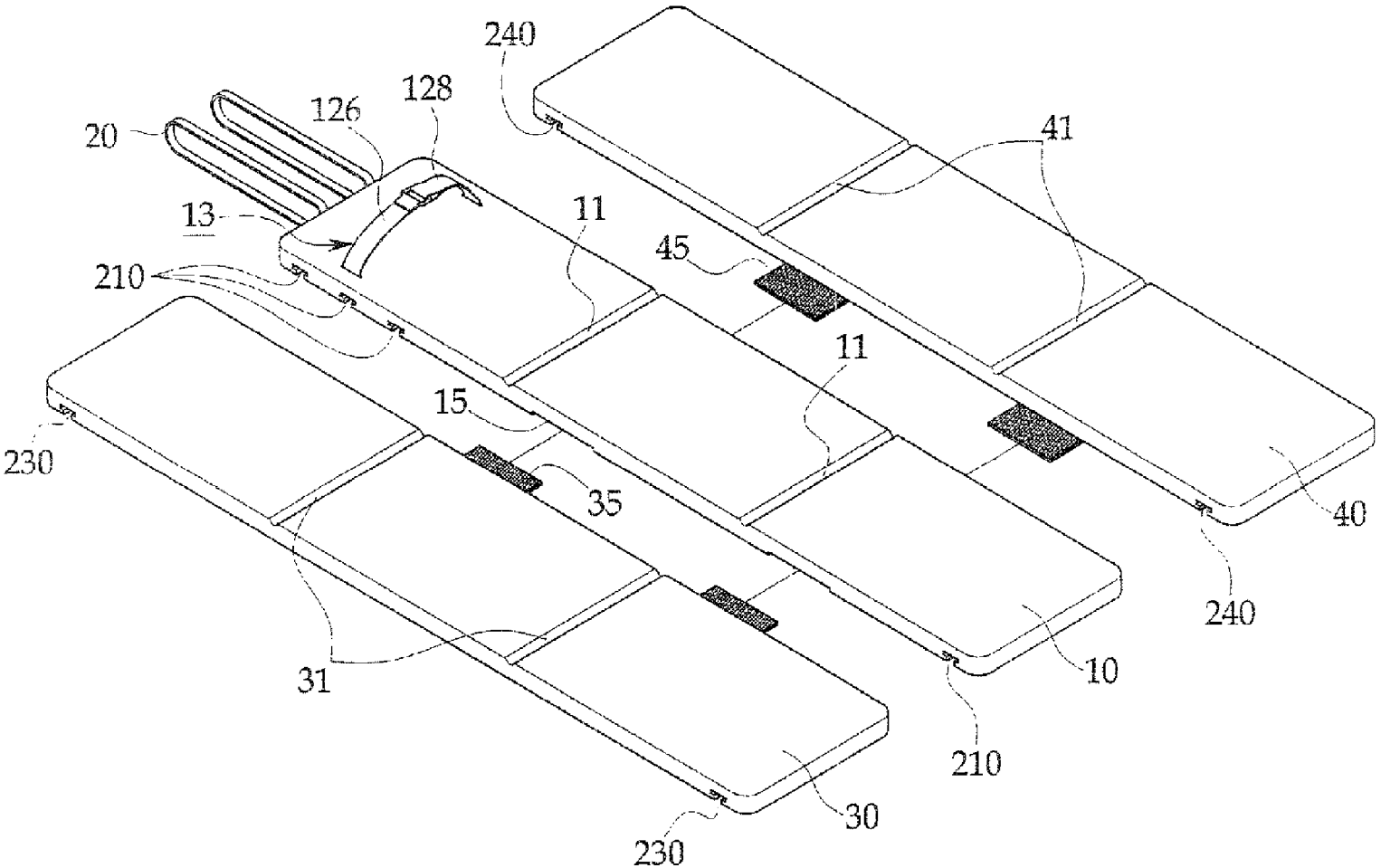

[Fig. 7]
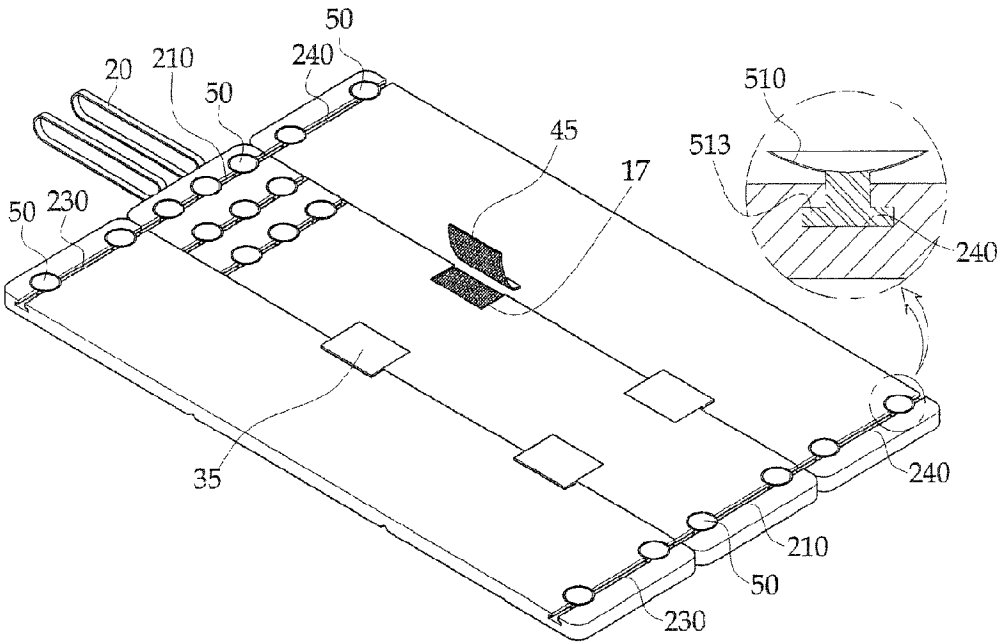
[Fig. 8]
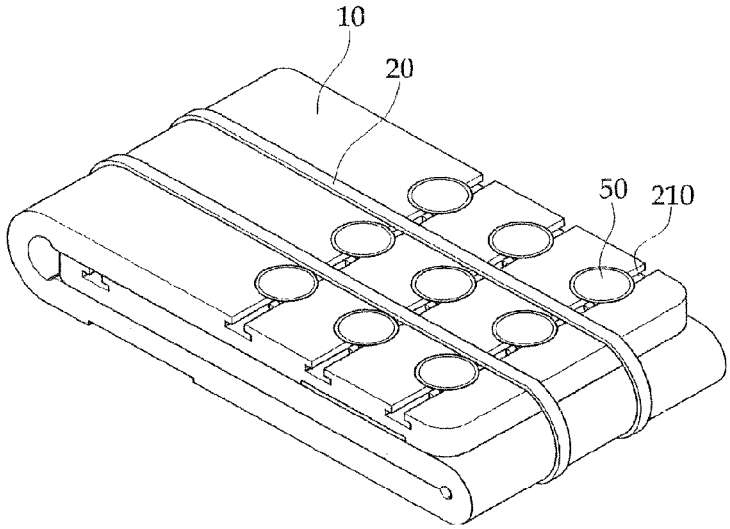

[Fig. 9]
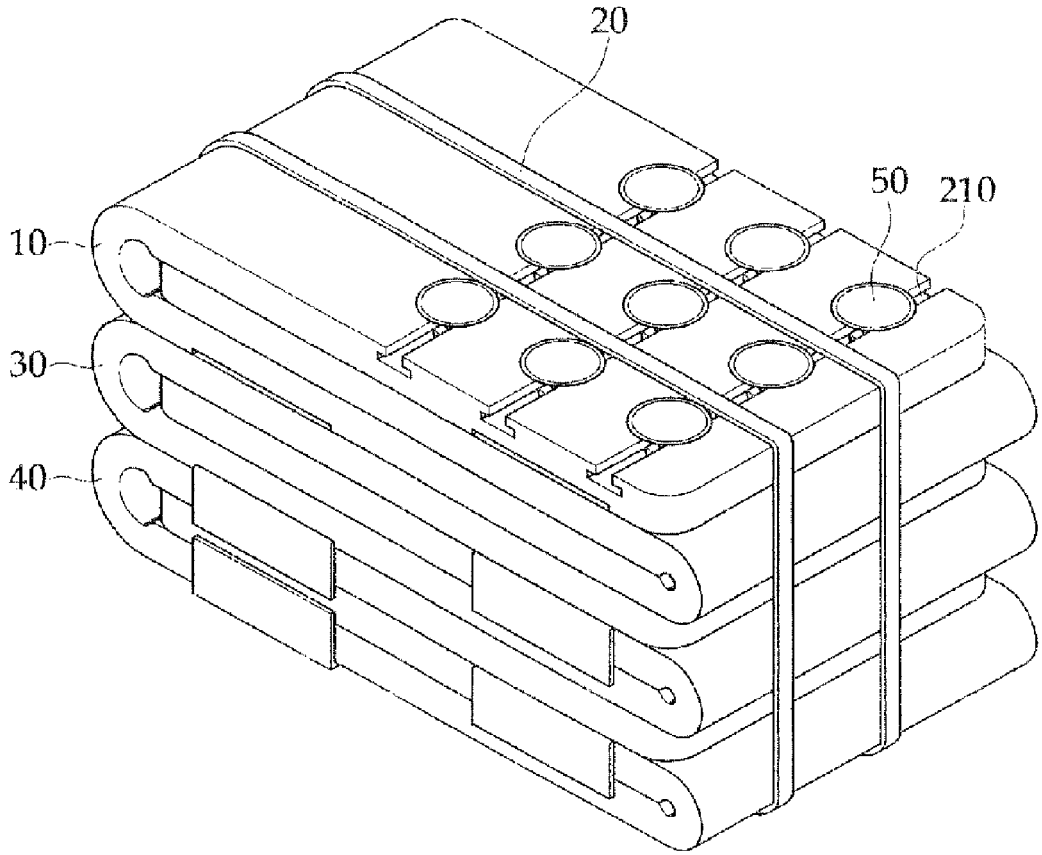

MAT FOR EXERCISE

TECHNICAL FIELD

The present invention relates to a mat for exercise. More particularly, the present invention relates to a mat for exercise, especially used for free exercise, yoga or a sit-up, in which the mat is firmly fixed to a floor, so that the mat can be prevented from moving along with movement of a player and the player can easily perform the sit-up.

BACKGROUND ART

In general, a mat for floor exercise uses coil-type compression springs to provide elasticity. The compression springs may damage a floor and a board of a gymnasium having the mat installed therein. When the mat is used for a long period of time, noise may occur due to the compression springs. Further, in order to attach the compression springs to the bottom surface of the board, a spring fixing tool must be additionally provided. Furthermore, a process for exchanging a damaged spring is complicated.

In a case in which boards equipped with springs are fixedly connected to each other, since an impact load generated when a player lands on a mat during the floor exercise is transferred to the whole area of the boards, elasticity to be taken by the player is reduced. Thus, the player cannot sufficiently exhibit his/her skill.

At the present time, a cushion is provided by placing scrolls on the board. However, the cushion board may be partially contracted and deformed when it is used for a long period of time, so a player performing the floor exercise may lose the balance. And, in that case, large portion of the cushion board has to be replaced at the same time.

Conventionally, carpets are coupled with each other by means of heat bond tapes. However, if an impact is applied to the heat bond tape in a state where the temperature and moisture are low, the gluey component of the heat bond tape is broken. Further, if the heat bond tape adheres to the carpet once, the heat bond tape cannot be easily detached from the carpet.

Although a sit-up is a kind of free exercise having a superior exercise effect, an assistant for fixing the ankle of a player or an additional tool for grasping the foot of the player is required for the sit-up, causing inconvenience to the player. Thus, many people unconsciously avoid the sit-up.

In addition, a mat generally used in sports and fitness clubs is of small size suitable for only one person, so it is inconvenient for many people to use it in a group.

DISCLOSURE OF INVENTION

Technical Problem

Accordingly, the present invention has been made to solve the above-mentioned problems in the prior art. An object of the present invention is to provide a mat for exercise, which can be firmly fixed to a floor in use.

Another object of the present invention is to provide a mat for exercise, in which a user can perform a sit-up by himself/herself without help of another person.

Further another object of the present invention is to provide a mat for exercise, in which a plurality of mats can be detachably coupled to each other in use.

Still another object of the present invention is to provide a mat for exercise, in which a user can simply fold and store the mat after use.

Yet another object of the present invention is to provide a mat for exercise, in which attachment plates are detachably coupled with a plurality of guide grooves formed at the bottom surface of the mat, so that a player can use the mat in various ways according to individual preference.

Technical Solution

According to an aspect of the present invention, there is provided a mat for exercise comprising: a main mat having a foot hanger for a sit-up at a top surface of one side thereof and a plurality of grooves at a bottom surface of both lateral sides thereof; a plurality of sub-mats coupled with the main mat in use; and a plurality of attachment plates installed at corners of a bottom surface of the main mat and corners of bottom surfaces of the sub-mats, wherein the main mat is provided with female fabric hook-and-loop fastener (e.g., Velcro) tapes mounted at the grooves thereof, and the sub-mat is provided with male fabric hook-and-loop fastener (e.g., Velcro)tapes that laterally protrude corresponding to the grooves of the main mat.

According to another aspect of the present invention, there is provided a mat for exercise comprising: a main mat having a foot hanger for a sit-up at a top surface of one side thereof, a plurality of grooves at a bottom surface of both lateral sides thereof, and a plurality of guide grooves at both end portions of a bottom surface thereof in a width direction; a plurality of sub-mats coupled with the main mat in use, and having a plurality of guide grooves at both end portions of a bottom surface thereof in a width direction; and a plurality of attachment plates detachably coupled with the guide grooves of the main mat and the guide grooves of the sub-mats, wherein the main mat is provided with female fabric hook-and-loop fastener (e.g., Velcro) tapes mounted at the grooves thereof, and the sub-mat is provided with male fabric hook-and-loop fastener (e.g., Velcro) tapes that laterally protrude corresponding to the grooves of the main mat.

The main mat has a plurality of folding groove sections extending widthwise on a top surface thereof, and each sub-mat has a plurality of folding groove sections extending widthwise on a top surface thereof.

The main mat has a first slit and a second slit at one side thereof, the foot hanger comprises a first belt fixedly coupled with an inner side of the main mat by passing through the first slit, a connection ring connected to an end portion of the first belt, and a second belt fixedly coupled with the inner side of the main mat by passing through the second slit, and the second belt has a male fabric hook-and-loop fastener (e.g., Velcro) tape at an outer side of an end portion thereof, and a long female fabric hook-and-loop fastener (e.g., Velcro) tape at an outer side thereof adjacent to the second slit.

The mat further comprises a plurality of attachment plates installed at the bottom surface of the main mat in opposition to the foot hanger.

The mat further comprises a fastening member installed at one end of the main mat.

Advantageous Effects

According to the mats for exercise of various embodiments of the present invention as described above, the mats are firmly fixed to the floor, so that a user can be prevented from sliding or being damaged during exercise, and can perform a sit-up by himself/herself without help of another person.

Further, a plurality of mats can be easily separated from or coupled with each other, and can be simply folded and stored after use.

Furthermore, a plurality of guide grooves are formed at the bottom surface of the mats and the attachment plates are easily separated from or coupled with the guide grooves, so that the fixing force can be adjusted by changing the number of the attachment plates according to the age or weight of users.

Although an exemplary embodiment of the present invention has been described for illustrative purposes, those skilled in the art will appreciate that various modifications, additions and substitutions are possible, without departing from the scope and spirit of the invention as disclosed in the accompanying claims.

BRIEF DESCRIPTION OF THE DRAWINGS

The above and other advantages of the present invention will become readily apparent by reference to the following detailed description when considered in conjunction with the accompanying drawings wherein:

FIG. 1 is a front perspective view illustrating a mat for exercise according to one embodiment of the present invention;

FIG. 2 is a bottom perspective view illustrating the mat for exercise shown in FIG. 1;

FIG. 3 is a sectional view taken along line A-A in FIG. 2;

FIG. 4 is a perspective view illustrating a state in which one mat for exercise is folded according to one embodiment of the present invention;

FIG. 5 is a perspective view illustrating a state in which a plurality of mats for exercise are folded according to one embodiment of the present invention;

FIG. 6 is a front perspective view illustrating a mat for exercise according to another embodiment of the present invention;

FIG. 7 is a bottom perspective view illustrating the mat for exercise shown in FIG. 6;

FIG. 8 is a perspective view illustrating a state in which one mat for exercise is folded according to another embodiment of the present invention; and FIG. 9 is a perspective view illustrating a state in which a plurality of mats for exercise are folded according to another embodiment of the present invention.

MODE FOR THE INVENTION

Hereinafter, a mat for exercise according to various embodiments of the present invention will be described in detail with reference to the accompany drawings.

FIG. 1 is a front perspective view illustrating a mat for exercise according to one embodiment of the present invention, FIG. 2 is a bottom perspective view illustrating the mat for exercise shown in FIG. 1, FIG. 3 is a sectional view taken along line A-A in FIG. 2, FIG. 4 is a perspective view illustrating a state in which one mat for exercise is folded according to one embodiment of the present invention, and FIG. 5 is a perspective view illustrating a state in which a plurality of mats for exercise are folded according to one embodiment of the present invention.

As illustrated in FIGS. 1 to 3, the mat for exercise according to the present invention comprises a main mat 10 and a plurality of sub-mats coupled with the main mat 10.

Preferably, the main mat 10 and the sub-mats comprise a member having a cushion to attenuate an impact.

The main mat 10 comprises a plurality of folding groove sections 11 extending widthwise on a top surface of the main mat such that the mat can be easily folded. Further, the main mat 10 has a pair of slits 114 and 116 at one side thereof and a foot hanger 13 for a sit-up is fixedly coupled with the inner side of the main mat 10 through the slits 114 and 116.

The foot hanger 13 comprises a first belt 126 fixedly coupled with the inner side of the main mat 10 by passing through the slit 114, a connection ring 124 connected to the end portion of the first belt 126, and a second belt 128 fixedly coupled with the inner side of the main mat 10 by passing through the slit 116.

Further, the foot hanger 13 comprises a male fabric hook-and-loop fastener (e.g., Velcro) tape 134 installed at the outer side of the end portion of the second belt 128, and a long female fabric hook-and-loop fastener (e.g., Velcro) tape 136 installed at the outer side of the second belt 128 adjacent to the slit 116.

When a user performs a sit-up, he/she places his/her ankle between the first and second belts 126 and 128, pulls the second belt 128 by passing through the connection ring 124 such that the ankle can be fixed by the first and second belts 126 and 128, and then attaches the male fabric hook-and-loop fastener (e.g., Velcro) tape 134 to a proper position of the female fabric hook-and-loop fastener (e.g., Velcro) tape 136. Accordingly, the user can perform the sit-up in a state in which force grasping the ankle is optimized. As a result, the user can perform the sit-up without the help of another person who grasps the ankle.

The foot hanger 13 having the structure as described above is for illustrative purposes only. It should be noted that the foot hanger 13 can be variously modified within the scope of the claims of the present invention.

The main mat 10 has a plurality of grooves 15 at the bottom surface of both lateral sides thereof, and female fabric hook-and-loop fastener (e.g., Velcro) tapes 17 are mounted at the grooves 15, respectively.

Further, a fastening member 20 can be installed at one end of the main mat 10. The fastening member 20 can be prepared in the form of an elastic band or a device having a string and a fastener.

The sub-mat comprises a first sub-mat 30 and a second sub-mat 40. Such a structure of the sub-mat is for convenience of description about the present invention. Accordingly, a plurality of sub-mats can be coupled with the main mat as occasion demands.

The first sub-mat 30 has a plurality of folding groove sections 31 extending widthwise on the top surface thereof such that the mat can be easily folded, and the second sub-mat 40 also has a plurality of folding groove sections 41 extending widthwise on the top surface thereof such that the mat can be easily folded.

The first sub-mat 30 has a male fabric hook-and-loop fastener (e.g., Velcro) tape 35 that laterally protrudes corresponding to the left groove 15 of the main mat 10, and the second sub-mat 40 has a male fabric hook-and-loop fastener (e.g., Velcro) tape 45 that laterally protrudes corresponding to the right groove 15 of the main mat 10.

As shown in FIGS. 2 and 3, the main mat 10 has a plurality of attachment plates 50 at the corners of the bottom surface thereof. The attachment plates 50 closely make contact with the floor to fix the main mat 10 to the floor. More attachment plates 50 can be installed at the bottom surface of the main mat 10 in opposition to the foot hanger 13, so that the mat can be firmly fixed without movement during the sit-up. Since a user performs the sit-up with placing the ankle into the foot hanger 13, the greatest force is applied to the foot hanger 13. So the main mat 10 can be easily separated from the floor. In order to prevent the main mat 10 from being separated from the floor, more of attachment plates 50 are installed at the bottom surface of the mat in opposition to the foot hanger 13.

Further, the attachment plates 50 are installed at corners of the first sub-mat 30 and the second sub-mat 40, respectively, so that the first sub-mat 30 and the second sub-mat 40 can be prevented from being easily separated from the floor.

As shown in FIG. 4, only one main mat 10 can be folded along the folding groove sections 11 and then tied by using the fastening member 20. As shown in FIG. 5, the main mat 10 and the sub-mat can be folded, respectively, and then tied by using the fastening member 20 at one time. Further, the first sub-mat 30 and the second sub-mat 40 can be folded and stored, respectively.

FIG. 6 is a front perspective view illustrating a mat for exercise according to another embodiment of the present invention, FIG. 7 is a bottom perspective view illustrating the mat for exercise shown in FIG. 6, FIG. 8 is a perspective view illustrating a state in which one mat for exercise is folded according to another embodiment of the present invention, and FIG. 9 is a perspective view illustrating a state in which a plurality of mats for exercise are folded according to another embodiment of the present invention.

The mat for exercise according to another embodiment of the present invention is identical to the mat for exercise according to one embodiment of the present invention, except that the mat for exercise according to another embodiment of the present invention has a structure in which the attachment plates can be separated from the main mat or a greater number of attachment plates can also be mounted at the main mat. Accordingly, the same reference numerals are used to designate the same elements.

As illustrated in FIGS. 6 and 7, a plurality of guide grooves 210 extend widthwise on the bottom surface of a main mat 10. In detail, a plurality of the guide grooves 210 can be installed at one end of the bottom surface of a main mat 10 in opposition to the foot hanger 13, and one guide groove 210 can be installed at the other end of the bottom surface of the main mat 10.

Further, guide grooves 230 extend widthwise on the bottom surface of a first sub-mat 30 and guide grooves 240 extend widthwise on the bottom surface of a second sub-mat 40.

A plurality of attachment plates 50 can be slidably coupled with or separated from the guide grooves 210, 230 and 240. The attachment plate 50 comprises an attachment section 510 and a flange 513. The flange 513 has a shape corresponding to the guide grooves 210, 230 and 240 such that the flange 513 can slide along the guide grooves 210, 230 and 240.

According to the present invention as described above, the attachment plate 50 are separated from or coupled with the guide grooves. When an adult or a weighty person uses the mat, the number of the attachment plates 50 coupled with the guide grooves is increased to enhance fixing force. Further, when a child or a light person uses the mat, the number of the attachment plates 50 coupled with the guide grooves is decreased to reduce the fixing force. Accordingly, a child or a woman can easily separate the mat from the floor after exercise.

As shown in FIG. 8, only one main mat 10 according to another embodiment of the present invention can be folded along the folding groove sections 11 and then tied by using the fastening member 20. As shown in FIG. 9, the main mat 10 and the sub-mat according to another embodiment of the present invention can be folded, respectively, and then tied by using the fastening member 20 at one time.

The mats for exercise according to the present invention as described above can be simply used for exercise. However, the mats can be used outdoors in various ways if circumstances allow. For example, when a user pitches a tent, the mats of the present invention can be installed on the inner bottom surface of the tent. Further, male and female fabric hook-and-loop fastener (e.g., Velcro) tapes can be installed on the bottom of the tent and at the bottom surface of the mat of the present invention respectively, so that the tent can be fixedly coupled with the mat.

The invention claimed is:

1. A mat for exercise comprising:

a main mat having a foot hanger that allows for a user's feet to be secured for sit-up exercises at a top surface of one side thereof and a plurality of grooves at a bottom surface of both lateral sides thereof;

a plurality of sub-mats coupled with the main mat in use; and a plurality of attachment plates installed at corners of a bottom surface of the main mat and corners of bottom surfaces of the sub-mats, wherein the main mat is provided with female Velcro tapes mounted at the grooves thereof, and the sub-mat is provided with male Velcro tapes that laterally protrude corresponding to the grooves of the main mat, and wherein the main mat has a first slit and a second slit at one side thereof, the foot hanger comprises a first belt fixedly coupled with an inner side of the main mat and passing through the first slit, a connection ring connected to an end portion of the first belt, and a second belt fixedly coupled with the inner side of the main mat and passing through the second slit.

2. A mat for exercise comprising:

a main mat having a foot hanger that allows for a user's feet to be secured for sit-up exercises at a top surface of one side thereof, a plurality of first grooves at a bottom surface of both lateral sides thereof, and a plurality of guide grooves at both end portions of a bottom surface thereof in a width direction;

a plurality of sub-mats coupled with the main mat in use, and having a plurality of guide grooves at both end portions of a bottom surface thereof in a width direction; and a plurality of attachment plates detachably coupled with the guide grooves of the main mat and the guide grooves of the sub-mats, wherein the main mat is provided with female Velcro tapes mounted at the first grooves thereof, and the sub-mat is provided with male Velcro tapes that laterally protrude corresponding to the first grooves of the main mat.

3. The mat for exercise according to claim 1, wherein the main mat has a plurality of folding groove sections extending widthwise on a top surface thereof, and each sub-mat has a plurality of folding groove sections extending widthwise on a top surface thereof.

4. The mat for exercise according to claim 1, wherein the second belt has a male Velcro tape at an outer side of an end portion thereof, and a long female Velcro tape at an outer side thereof adjacent to the second slit.

5. The mat for exercise according to claim 1, further comprising a plurality of attachment plates installed at the bottom surface of the main mat in opposition to the foot hanger.

6. The mat for exercise according to claim 1, further comprising a fastening member installed at one end of the main mat.

7. The mat for exercise according to claim 2, wherein the main mat has a plurality of folding groove sections extending widthwise on a top surface thereof, and each sub-mat has a plurality of folding groove sections extending widthwise on a top surface thereof.

8. The mat for exercise according to claim 2, wherein the main mat has a first slit and a second slit at one side thereof, the foot hanger comprises a first belt fixedly coupled with an inner side of the main mat and passing through the first slit, a connection ring connected to an end portion of the first belt, and a second belt fixedly coupled with the inner side of the main mat and passing through the second slit, and the second belt has a male Velcro tape at an outer side of an end portion thereof, and a long female Velcro tape at an outer side thereof adjacent to the second slit.

9. The mat for exercise according to claim 2, further comprising a plurality of attachment plates installed at the bottom surface of the main mat in opposition to the foot hanger.

10. The mat for exercise according to claim 2, further comprising a fastening member installed at one end of the main mat.

* * * * *